US006594456B2

(12) United States Patent
Kimizuka et al.

(10) Patent No.: US 6,594,456 B2
(45) Date of Patent: Jul. 15, 2003

(54) IMAGE FORMING APPARATUS

(75) Inventors: Eiichiro Kimizuka, Shizuoka (JP); Hiroshi Hashimoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/911,451

(22) Filed: Jul. 25, 2001

(65) Prior Publication Data

US 2002/0025180 A1 Feb. 28, 2002

(30) Foreign Application Priority Data

Jul. 26, 2000 (JP) ..... 2000-224961
Nov. 8, 2000 (JP) ..... 2000-340994

(51) Int. Cl.[7] ..... G03G 21/00
(52) U.S. Cl. ..... 399/92; 399/44; 399/94
(58) Field of Search ..... 399/92, 44, 94

(56) References Cited

U.S. PATENT DOCUMENTS

| | | | | |
|---|---|---|---|---|
| 5,083,168 A | | 1/1992 | Kusaka et al. | 355/285 |
| 5,148,226 A | | 9/1992 | Setoriyama et al. | 355/290 |
| 5,210,579 A | | 5/1993 | Setoriyama et al. | 355/285 |
| 5,262,834 A | | 11/1993 | Kusaka et al. | 355/285 |
| 5,525,775 A | | 6/1996 | Setoriyama et al. | 219/216 |
| 6,043,906 A | * | 3/2000 | Kikuchi | 358/475 |
| 6,266,498 B1 | * | 7/2001 | Oda et al. | 399/92 |

FOREIGN PATENT DOCUMENTS

| | | | |
|---|---|---|---|
| JP | 63-142378 | * | 6/1988 |
| JP | 63-313182 | | 12/1988 |
| JP | 2-157878 | | 6/1990 |
| JP | 4-44075 | | 2/1992 |
| JP | 4-44076 | | 2/1992 |
| JP | 4-44077 | | 2/1992 |
| JP | 4-44078 | | 2/1992 |
| JP | 4-44079 | | 2/1992 |
| JP | 4-44080 | | 2/1992 |
| JP | 4-44081 | | 2/1992 |
| JP | 4-44082 | | 2/1992 |
| JP | 4-44083 | | 2/1992 |
| JP | 4-204980 | | 7/1992 |
| JP | 4-204981 | | 7/1992 |
| JP | 4-204982 | | 7/1992 |
| JP | 4-204983 | | 7/1992 |
| JP | 4-204984 | | 7/1992 |
| JP | 58-83875 | * | 5/1993 |
| JP | 11-38861 | * | 2/1999 |

* cited by examiner

*Primary Examiner*—Quana M. Grainger
(74) *Attorney, Agent, or Firm*—Fitzpatrick, Cella, Harper & Scinto

(57) ABSTRACT

In an image forming apparatus having a suction type fan, a thermistor is disposed in a vicinity of the suction type fan and the outside air (outside air intake port), and the forced convection by the fan is utilized, whereby it is made possible to detect the outside air temperature with good accuracy (accurately and with good response) and obtain the information thereof. Also, in an image forming apparatus for effecting image recording on a recording sheet by the electrophotographic process, including a cooling fan, an outside air thermistor (temperature sensor) disposed in a vicinity of the cooling fan, and outside air temperature calculating device for calculating the outside air temperature on the basis of temperature information from the outside air thermistor, wherein the parameter of the electrophotographic process is changed on the basis of outside air temperature information from the outside air temperature calculating device, the outside air temperature calculating device finds an average value obtained by averaging temperatures detected by the outside air thermistor during the non-recording operation for a predetermined time, and judges a value obtained by subtracting a predetermined value from the average value as the outside air temperature.

13 Claims, 12 Drawing Sheets

IMAGE FORMING APPARATUS

BACKGROUND OF THE INVENTION

1. Field of the Invention

The invention relates to an image forming apparatus for effecting image recording by way of an electrophotographic process. The invention also relates to an image forming apparatus having a temperature detecting sensor for controlling image forming conditions.

2. Description of the Related Art

An image forming apparatus such as a laser printer or a copier has heretofore detected the outside air temperature by a temperature detecting element such as a thermistor disposed therein, and has appropriately determined a process parameter such as the temperature of a heat-fixing device by outside air temperature information.

However, the temperature detecting element such as a thermistor is disposed in the apparatus, and this leads to the problem that the outside air temperature cannot be accurately detected under the influence of the self temperature rise of the apparatus.

Also, as an image forming apparatus of this kind, there is an image forming apparatus of the electrophotographic type such as a laser printer or a copier. The image forming apparatus of the electrophotographic type according to the related art will hereinafter be described with reference to FIG. 10 of the accompanying drawings. FIG. 10 is a typical cross-sectional view of the image forming apparatus according to the related art.

A recording medium 2 set in a sheet feeding cassette 3*a* is conveyed to a transferring position by a pickup roller 3*b*, a pair of feed and retard rollers 3*c*, a pair of conveying rollers 3*d* and a pair of conveying rollers 3*e*. A transferring roller 4 as transferring means is disposed at the transferring position, and by a voltage being applied thereto, the transferring roller 4 transfers a toner image on a photosensitive drum 7 to the recording medium 2.

The photosensitive drum 7 is charged by charging means 8, and then a laser beam is applied thereto from optical means 1, whereby a latent image conforming to image information is formed on the photosensitive drum 7. This latent image is developed into a visible image, i.e., a toner image, by developing means 9.

The recording medium 2 to which the toner image has been transferred is conveyed to fixing means 5 via a conveying belt 3*f*. The fixing means 5 applies heat and pressure to the recording medium 2 passing therethrough to thereby fix the transferred toner image on the recording medium 2.

Particularly, if the fixing means is of a film heating type (disclosed in Japanese Patent Application Laid-Open No. 63-313182, Japanese Patent Application Laid-Open No. 2-157878, Japanese Patent Applications Laid-Open Nos. 4-44075 through 44083, Japanese Patent Applications Laid-Open Nos. 4-204980 through 204984, etc.), heat-resistant film (heat-resistant fixing film) which is a heating rotary member is brought into close contact with a heat generating member by a pressurizing rotary member (elastic roller).

A pressure contact nip portion is formed with the heat-resistant fixing film nipped between the heating member and the pressurizing member, and the recording medium bearing an unfixed image thereon is introduced into between the heat-resistant fixing film and the pressurizing member and is conveyed with the heat-resistant fixing film, and by the heat from the heating member imparted through the heat-resistant fixing film and the pressure of the pressure contact nip portion, the unfixed image is fixed as a permanent image on the recording medium.

Thereafter, the recording medium is conveyed and discharged onto a discharge tray 6 by a pair of discharge rollers 3*g* and a pair of discharge rollers 3*h*.

A thermistor (not shown) is provided in the fixing means 5, and on the basis of detected temperature information, a suitable fixing temperature is determined and temperature adjustment is effected. Also, appropriate transfer control is effected on the basis of an electric current or a voltage in the transferring roller 4 when the recording medium 2 is or is not nipped between the photosensitive drum 7 and the transferring roller 4.

As described above, there is adopted a process of applying feedback on the basis of the information in the control device chiefly from a point of time at which the recording medium 2 has arrived at the fixing means 5 or the control means of the transferring roller 4.

Also, a fan 10 is provided on the side surface of the main body of the image forming apparatus. The fan 10 takes in the outside air into an air trunk formed in the apparatus to prevent the inside air of the apparatus from rising.

In the case of the related art as described above, however, there have arisen the following problems.

In the image forming apparatus as described above, particularly, if the fixing means is of the film heating type, a linear heating member of low heat capacity is used as the heating member and a thin film material of low heat capacity is used as the film and therefore, the saving of electric power and the shortening of the waiting time become possible, but there is also a side in which the image forming apparatus is liable to be affected by the temperature environment under which the apparatus is used. Accordingly, the amount of heat is liable to become excessive or deficient.

When the amount of heat is excessive, a portion of the toner image remains on the fixing film side and after one revolution of the film, a bad image in which that toner is transferred to the recording medium may occur. Also, when the amount of toner is deficient, there is the possibility of causing bad fixing.

As described above, the outside air temperature cannot be detected with good response and accurately and therefore, it has not been possible to effect appropriate fixing temperature control taking even the outside air temperature into account.

Also, when control of a transfer bias is performed, the outside air temperature cannot be detected with good response and accuracy, similar to the fixing temperature control. Therefore, it has not been possible to effect appropriate transfer bias control taking even the outside air temperature into account. This also may cause a bad image.

SUMMARY OF THE INVENTION

The present invention has been made in view of the above-noted problems and an object thereof is to provide an image forming apparatus in which the outside air temperature can be detected with high accuracy and a process parameter can be set appropriately.

To achieve the above object, the present invention is an image forming apparatus for effecting image recording on a recording sheet by the electrophotographic process. In one aspect, the apparatus comprises a cooling fan, a temperature sensor disposed in the vicinity of the cooling fan, and outside air temperature calculating means for calculating the outside air temperature on the basis of temperature information from the temperature sensor, wherein the parameter of the electrophotographic process is changed on the basis of outside air temperature information from the outside air temperature calculating means, characterized in that the outside air temperature calculating means finds an average value obtained by averaging temperatures detected by the temperature sensor during the non-recording operation for a predetermined time period, and a value obtained by subtracting a predetermined value from the average value is the outside air temperature.

Preferably, the image forming apparatus is characterized in that when a power source switch is ON, the outside air temperature calculating means judges a temperature detected by the temperature sensor immediately after the closing of the power switch as the outside air temperature, and retains the detected temperature as the outside air temperature for a predetermined time period.

Preferably, the image forming apparatus is characterized in that during the non-recording operation, the cooling fan is intermittently driven at a predetermined cycle period, and the outside air temperature calculating means judges a value obtained by subtracting a predetermined value from the average temperature at each predetermined cycle period as the outside air temperature.

According to the present invention, in an image forming apparatus for effecting image recording on a recording sheet by the electrophotographic process, the apparatus comprising a cooling fan, a temperature sensor disposed in the vicinity of the cooling fan, and outside air temperature calculating means for calculating the outside air temperature on the basis of temperature information from the temperature sensor, wherein the parameter of the electrophotographic process is changed on the basis of outside air temperature information from the outside air temperature calculating means, the outside air temperature calculating means finds an average value obtained by averaging temperatures detected by the temperature sensor during the non-recording operation for a predetermined time period, and judges a value obtained by subtracting a predetermined value from the average value as the outside air temperature and therefore, there is obtained the technical effect that the outside air temperature can be detected with high accuracy accurately and the process parameter can be set appropriately.

Another object of the present invention is to provide an image forming apparatus which makes the outside air temperature accurately detectable and makes the setting and control of an image forming condition corresponding to the outside air temperature possible and achieves an improvement in the quality of image.

To achieve the above object, according to a preferred embodiment of the present invention, an image forming apparatus provided with a temperature detecting sensor for detecting the ambient temperature, control means for controlling the setting of image forming conditions on the basis of the temperature detecting sensor, and outside air intake means for taking the outside air into the apparatus through an outside air intake port is characterized in that the temperature detecting sensor is installed in the vicinity of the outside air intake port.

Accordingly, the temperature detecting sensor is installed in the vicinity of the outside air intake port and can therefore detect the temperature of the outside air accurately.

Preferably, the outside air intake means may be a fan provided in the vicinity of an opening portion as the outside air intake port formed in the housing of the apparatus for creating an air flow from the external side toward the internal side of the apparatus through the opening portion, and the temperature detecting sensor may be installed in the vicinity of the fan.

Preferably, the outside air intake means may be a fan provided in the vicinity of an exhaust port formed in the housing of the apparatus for creating an air flow from the internal side toward the external side of the apparatus through the exhaust port, and an opening portion as the outside air intake port may be formed in the vicinity of the exhaust port with a partition wall therebetween, and the temperature detecting sensor may be installed in the vicinity of the opening portion.

Preferably, a plurality of air trunks may be formed by the fan, and one of them may be a air trunk directed from the opening portion to the exhaust port while being regulated by the partition wall.

Preferably, the image forming conditions of which the setting is controlled by the control means may include a heating temperature to fixing means for heating an unfixed image formed on a sheet to thereby fix the image to the sheet.

Preferably, the image forming conditions of which the setting is controlled by the control means may include a transfer bias to transferring means for transferring a developed image formed on an image bearing member onto a sheet.

Preferably, the image forming conditions of which the setting is controlled by the control means may include the outside air intake amount of the outside air intake means for adjusting the temperature of the interior of the apparatus.

Also, in the present invention, an image forming apparatus provided with a temperature detecting sensor for detecting the ambient temperature, control means for controlling the setting of image forming conditions on the basis of the temperature detecting sensor, an electrical equipment board and an apparatus housing having an opening portion as an outside air intake port is characterized in that in a projection plane of the main body of the apparatus as viewed a long the vertical direction, the temperature detecting sensor is disposed between the electrical equipment board and the housing.

Preferably, in the projection plane of the main body of the apparatus as viewed along the vertical direction, a fan for creating an air flow from the external side toward the internal side of the apparatus may be disposed between the board and the temperature detecting sensor.

According to the present invention, the temperature detecting sensor is installed in the vicinity of the outside air intake port and therefore, the temperature of the outside air can be detected accurately, and on the basis of the detected temperature, the setting of the image forming conditions can be controlled by the control means to thereby achieve an improvement in the quality of image.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Some preferred embodiments of the present invention will hereinafter be described in detail by way of example with reference to the drawings. However, the dimensions, materials, shapes and relative disposition of constituent parts described in these embodiments are not intended to restrict the scope of the present invention thereto unless specifically described.

<Embodiment 1>

Figure 1:
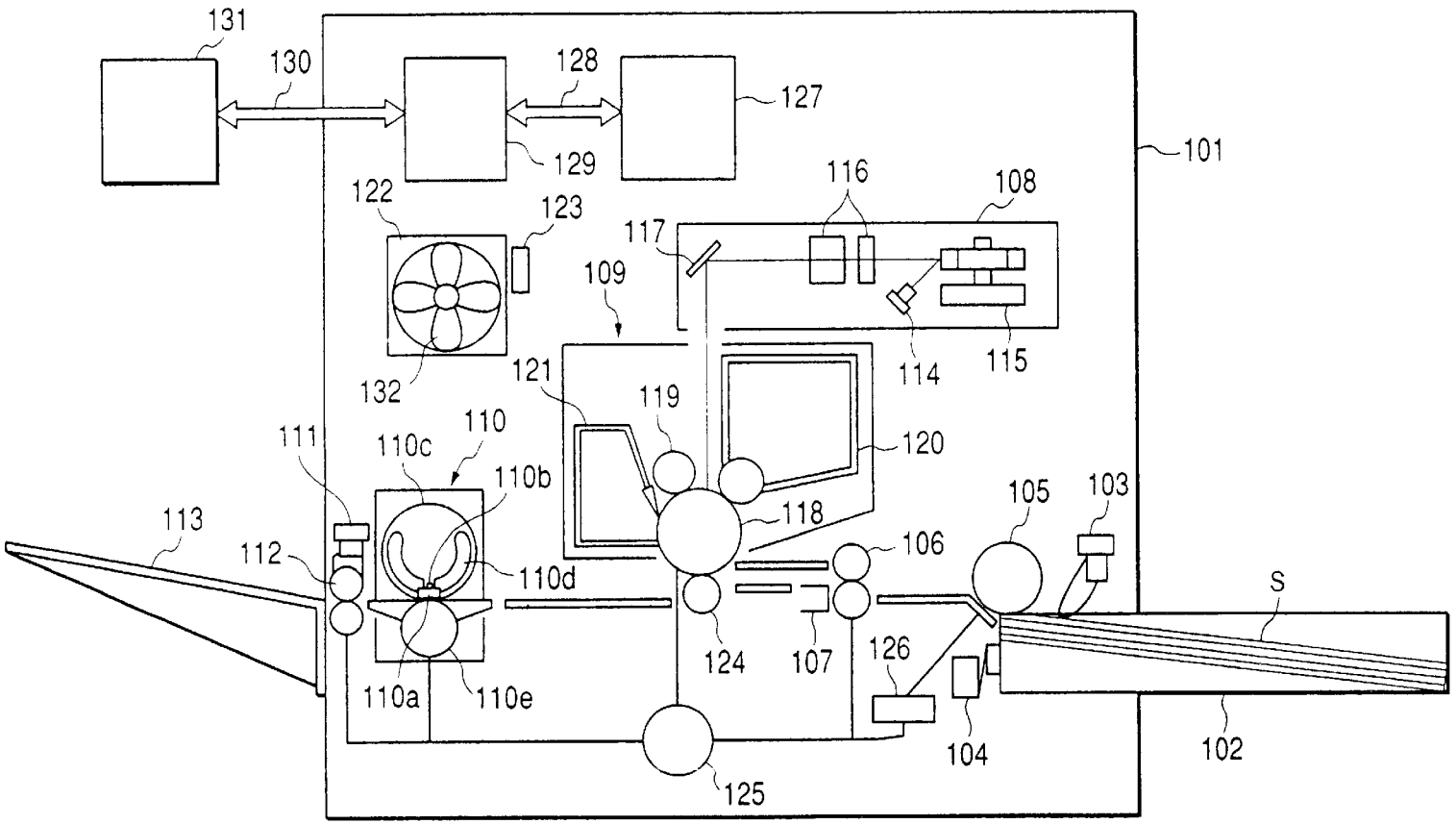
FIG. 1 is a cross-sectional view of an image forming apparatus (laser printer) according to the present invention.

FIG. 1 is a cross-sectional view of a laser printer according to the present invention, and as shown, the main body 101 of the laser printer has a cassette 102 containing recording sheets S therein, and around the cassette 102, there are provided a cassette sheet presence or absence sensor 103 for detecting the presence or absence of the recording sheet S in the cassette 102, a cassette size sensor (comprised of a plurality of microswitches) 104 for detecting the size of the recording sheets S in the cassette 102, a sheet feeding roller 105 for sending out the recording sheet S from the cassette 102, etc.

A pair of sheet feeding and conveying rollers 106 for conveying the recording sheet S are provided downstream of the sheet feeding roller 105, and a sheet feeding sensor 107 for detecting the conveyed state of the fed recording sheet S is provided downstream of the pair of sheet feeding and conveying rollers 106. An image forming portion 109 for forming a toner image on the recording sheet S on the basis of a laser beam from a laser scanner portion 108 is provided downstream of the sheet feeding sensor 107, and a fixing device 110 for heat-fixing the toner image formed on the recording sheet S is provided downstream thereof, and a sheet discharge sensor 111 for detecting the sheet conveying state of a sheet discharging portion and a pair of sheet discharging rollers 112 for discharging the recording sheet S and a stacking tray 113 for stacking thereon the recording sheets S on which recording has been completed are further provided downstream thereof.

The laser scanner portion 108 is comprised of a laser unit 114 emitting a laser beam modulated on the basis of an image signal (image signal VDO) delivered from an external device 131 which will be described later, a polygon motor 115 for scanning the laser beam from the laser unit 114 onto a photosensitive drum 118, an imaging lens unit 116, a turn-back mirror 117, etc.

The image forming portion 109 is constructed as a unit comprising the photosensitive drum 118, a primary charging roller 119, a developing device 120, a cleaner 121, etc. assembled together. The image forming portion 109 is detachably mountable to the main body 101 of the laser printer. A transfer charging roller 124 is installed at a location opposed to the photosensitive drum 118.

Thus, when the laser beam is scanned on the photosensitive drum 118 charged by the application of a high voltage to the primary charging roller 119, an electrostatic latent image is formed on the photosensitive drum 118, and the electrostatic latent image is developed as a toner image by a toner in the developing device 120. The toner image is transferred onto the recording sheet S when the recording sheet S passes the transfer charging roller 124.

The fixing device 110 is comprised of a ceramic heater 110*a* which is a heating source, a thermistor 110*b* for detecting the temperature of the ceramic heater 110*a*, polyimide film 110*c* containing the ceramic heater 110*a* and the thermistor 110*b* therein and rotated with the conveyance of the recording sheet S, a stay 110*d* holding the ceramic heater 110*a*, the thermistor 110*b* and the polyimide film 110*c*, and a pressure roller 110*e* which is in pressure contact with the ceramic heater 110*a* with the polyimide film 110*c* interposed therebetween.

Thus, an engine control device 127 detects the temperature of the thermistor 110*b* and controls the supply of electric power to the ceramic heater 110*a* to thereby effect fixing temperature control. When the recording sheet S passes the fixing device 110, the toner on the recording sheet S is fused and the toner image is fixed on the recording sheet S.

Now, a main motor 125 transmits its driving force to the sheet feeding roller 105 through a sheet feeding roller clutch 126 and also transmits its driving force to each unit of the image forming portion 109 including the pair of sheet feeding and conveying rollers 106 and the photosensitive drum 118, the fixing device 110 and the sheet discharging rollers 112. Also, a fan motor 122 drives a cooling fan 132 and introduces the outside air into the main body 101 to thereby prevent the internal temperature the apparatus from rising, and an outside air thermistor 123 which is a temperature detecting element is provided in the vicinity of the fan motor 122.

The engine control device 127 serves to control the main body 101 and is comprised of a timer, a ROM, a RAM, a CPU, various input and output control circuits, etc. This engine control device 127 is connected to a video control device 129 through a video interface 128 which is internal communication means.

The video control device 129 is also comprised of a timer, a ROM, a RAM, a CPU, various input and output control circuits, etc., and performs the function of converting image information transmitted from the external device 131 through a universal interface 130 including a network into a video signal, and transmitting the video signal to the engine control device 127 through the video interface 128.

Description will now be made of the printing operation of the laser printer having the above-described construction.

When the image information is transmitted from the external device 131 to the video control device 129 through the universal interface 130, the video control device 129 converts the image information into a video signal, and transmits the video signal to the engine control device 127 through the video interface 128 and also instructs the engine control device 127 to start the printing operation. In response to the instructions, the engine control device 127 starts the recording operation.

That is, it first starts to drive the main motor 125 and the polygon motor 115, and drives the sheet feeding roller clutch 126 and rotatively drives the sheet feeding roller 105 to thereby send out the recording sheet S from the cassette 102. Thereupon, the recording sheet S is conveyed to the image forming portion 109, in which the toner image is transferred onto the recording sheet S by way of the electrophotographic process. The recording sheet S onto which the toner image has been transferred is then conveyed to the fixing device 110, in which the recording sheet is subjected to the fixing of the toner image thereon. The fixing temperature of the fixing device 110 at this time is determined on the basis of outside air temperature information calculated on the basis of the temperature detected by the outside air thermistor 123.

Thereafter, the recording sheet S is discharged onto the stacking tray 113 and image recording is completed, but the fan motor 122 is still driven to prevent the internal temperature of the apparatus from rising.

Figure 2:
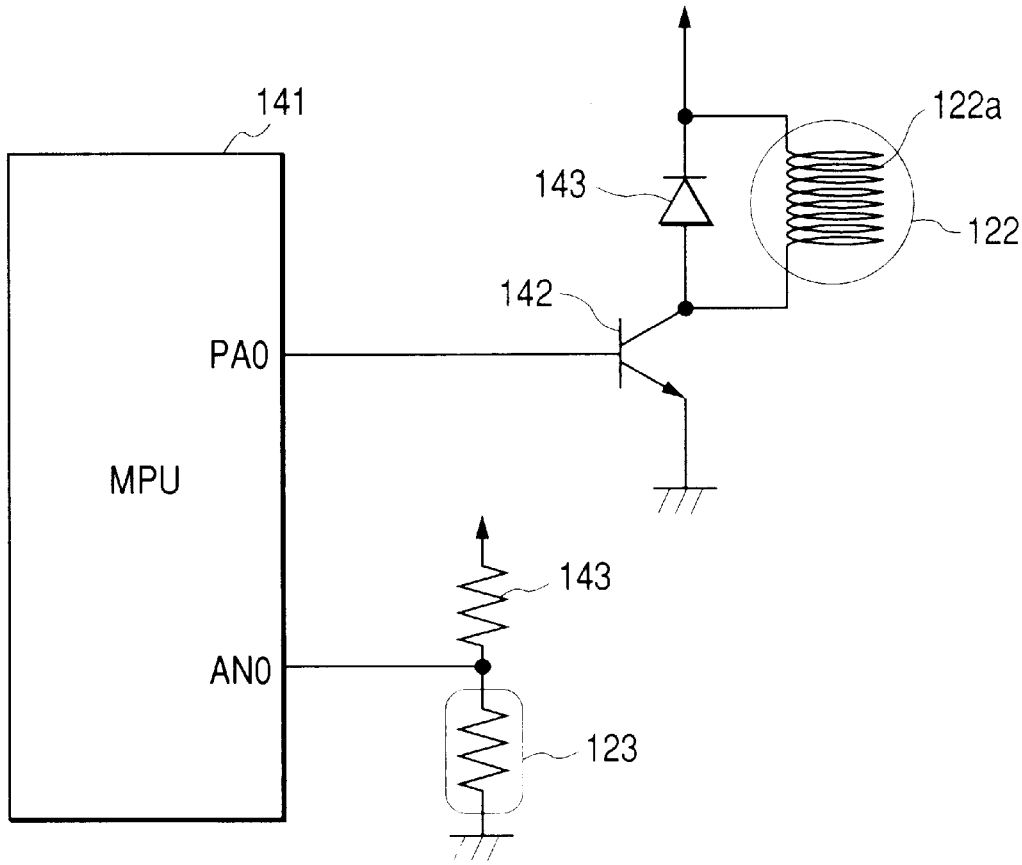
FIG. 2 shows the construction of a fan motor control and outside air temperature detecting circuit in an engine control device in the image forming apparatus (laser printer) according to the present invention.

FIG. 2 shows the construction of a fan motor control and outside air temperature detecting circuit in the engine control device 127. In FIG. 2, the reference numeral 141 designates a microprocessor (hereinafter referred to as the MPU), PAO denotes an output port, and ANO designates an analog input terminal having the A/D function of converting an analog voltage into a digital value and detecting the digital value.

Also, the reference numeral 142 denotes a transistor for driving the fan motor 122, and the base thereof is connected to the output port PAO of the MPU 141. The reference numeral 143 designates a surge absorbing diode for preventing the application of an overvoltage to the transistor 142 due to the induced voltage when the driving of the fan motor 122 is stopped.

Thus, when the MPU 141 renders PAO into "H", the transistor 142 is turned on and a coil 122*a* in the fan motor 122 is electrically energized, whereby the fan motor 122 is rotatively driven, and when the MPU 141 renders PAO into "L", the transistor 142 is turned off and the coil 122*a* is electrically deenergized, whereby the rotation of the fan motor 122 is stopped.

One end of the outside air thermistor 123 is connected to the earth (GND) and the other end thereof is connected to a pull-up resistor 143 and the analog input port ANO of the MPU 141, whereby the MPU 141 can detect the temperature of the vicinity of the fan motor 122.

Figure 3:
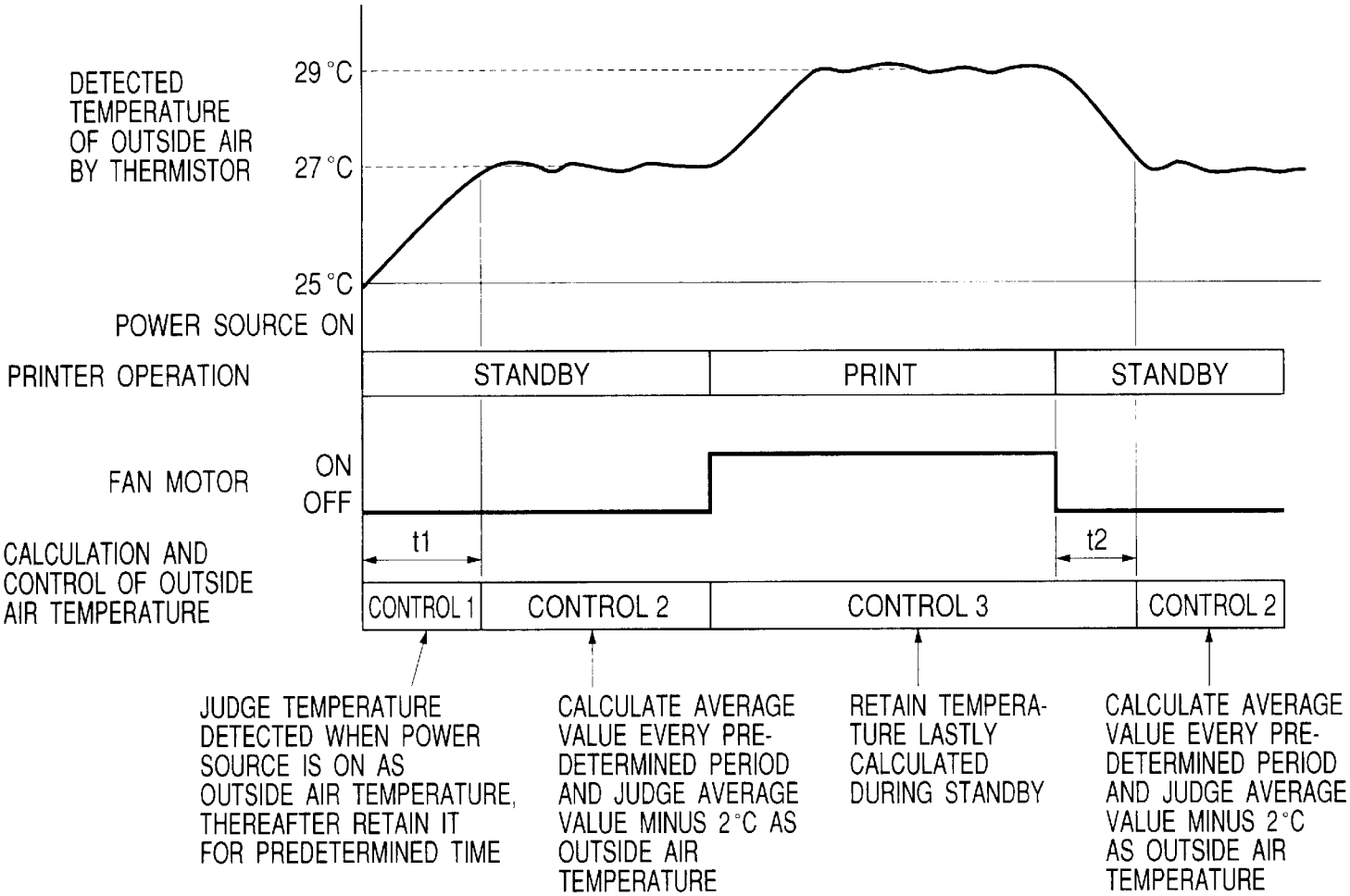
FIG. 3 is a timing chart showing outside air temperature calculation control in Embodiment 1 of the present invention.

FIG. 3 is a timing chart showing the outside air temperature calculation control when the state of the printer transits from ON of a power source to standby → print. The outside air temperature at this time is 25° C., and the outside air temperature control will hereinafter be described with reference to FIG. 3.

The detected temperature by the outside air thermistor 123 immediately after ON of the power source is judged as the outside air temperature, and that temperature is retained as the outside air temperature for a predetermined time period t1 during which the internal temperature of the apparatus is saturated (control 1). Thereafter, during standby, detected temperatures sampled at each predetermined cycle period (e.g. 10 sec.) are averaged to find an average temperature. Then, a value obtained by subtracting a predetermined temperature 2° C. having the internal temperature rise added thereto from the found average temperature is judged as the outside air temperature (control 2). During the printing and until a predetermined time period t2 has passed from the termination of the printing, a value lastly calculated during the standby immediately before the printing is retained as the outside air temperature (control 3). During the standby, "control 2" is effected again. In the present embodiment, during the standby, the fan motor 122 is stopped, and during the printing, the fan motor 122 is rotatively driven.

Thus, in the present embodiment, the outside air temperature calculating means is adapted to average the temperatures detected by the outside air thermistor 123 during the standby for a predetermined time to thereby find an average temperature, and judge a value obtained by subtracting a predetermined value (2° C.) from the average temperature as the outside air temperature and therefore, the outside air temperature can be detected with high accuracy and a process parameter can be set appropriately.

<Embodiment 2>

Embodiment 2 of the present invention will now be described.

Figure 4:
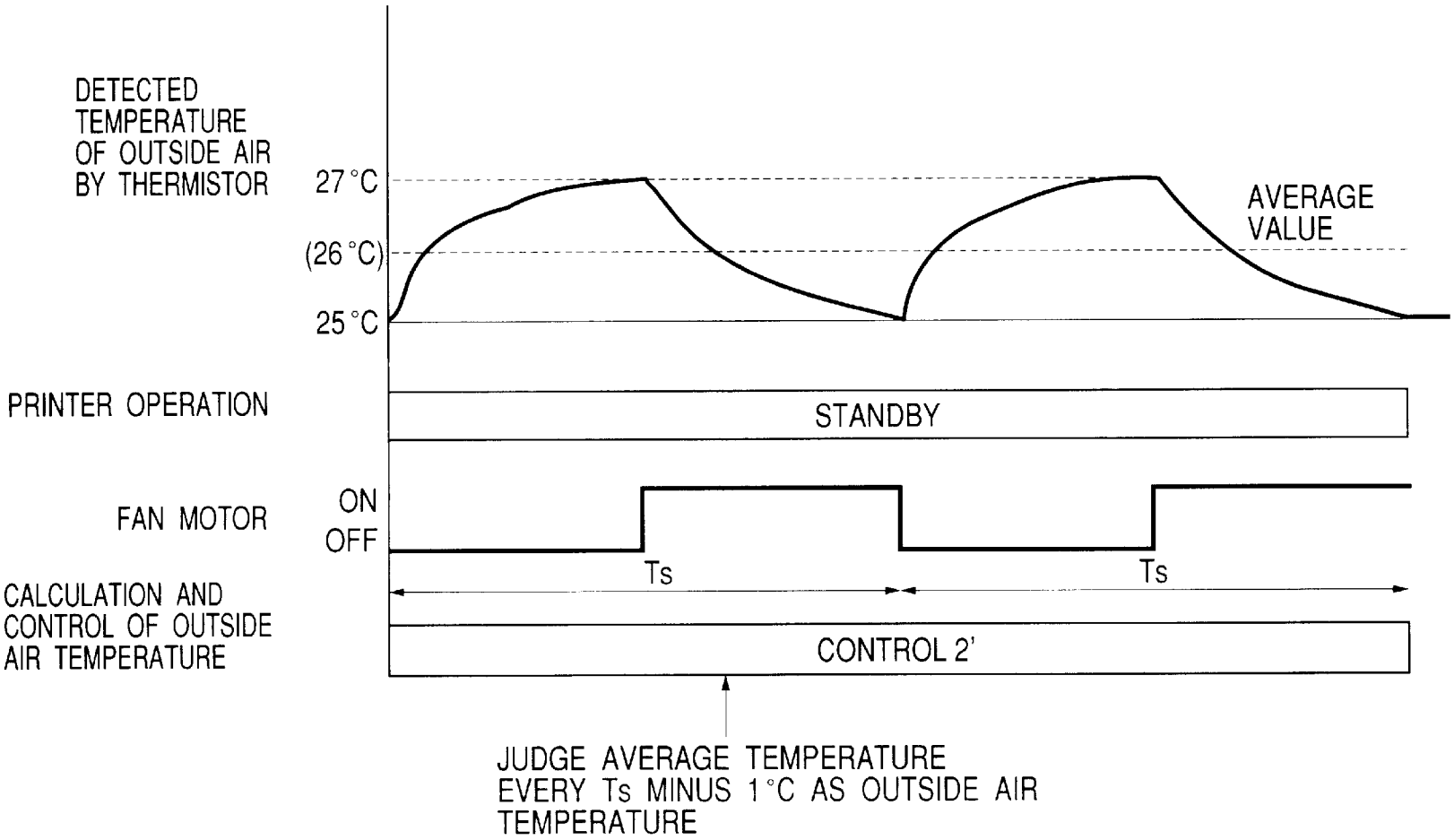
FIG. 4 is a timing chart showing outside air temperature calculation control in Embodiment 2 of the present invention.

The difference between the Embodiment 2 and the aforedescribed Embodiment 1 is that during the standby, the fan motor 122 is intermittently driven at a predetermined cycle period. The outside air temperature calculation control during the standby in this case will hereinafter be described with reference to FIG. 4.

Since there occurs a temperature ripple conforming to the driving ON/OFF cycle of the fan motor 122, design is made such that the average of the temperatures during one cycle (each time Ts) of ON/OFF of the fan motor 122 is calculated, and a value obtained by subtracting the offset value 1° C. of the temperature rising portion in the apparatus from the average value is judged as the outside air temperature (control 2').

<Embodiment 3>

Figure 5:
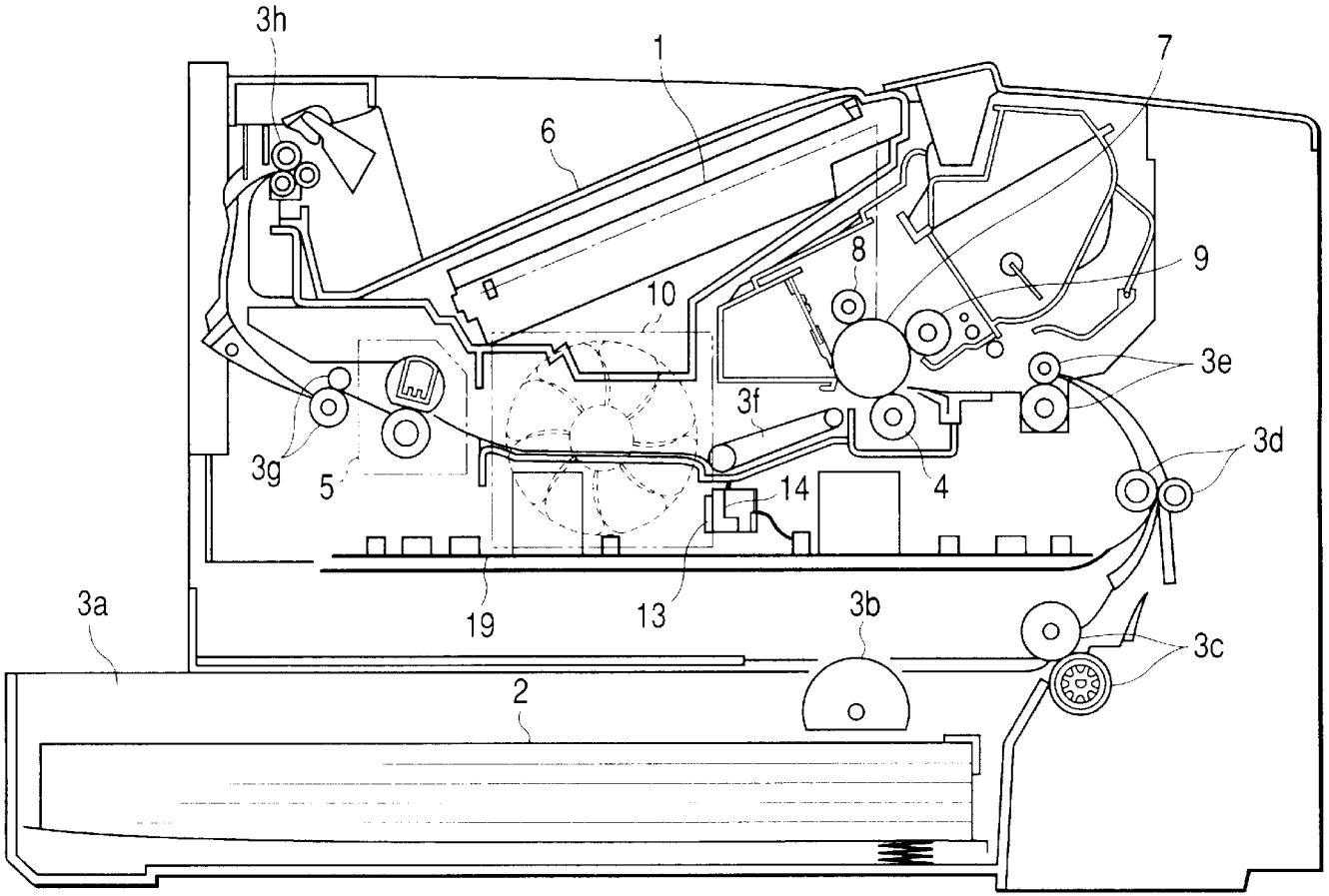
FIG. 5 is a typical cross-sectional view of an image forming apparatus according to an embodiment of the present invention.

An image forming apparatus according to a third embodiment of the present invention will now be described with reference to FIGS. 5 to 7 and FIGS. 12 and 13. The whole of the image forming apparatus will first be described with reference to FIG. 5 in particular. FIG. 5 is a typical cross-sectional view of the image forming apparatus according to the third embodiment of the present invention. For the simplicity of description, the same constituent portions as those in FIG. 10 referred to in the description of the related art are given the same reference characters.

Recording mediums (sheets) 2 set in a sheet feeding cassette 3*a* are fed by a pickup roller 3*b*, and are separated one by one and fed by a pair of feed and retard rollers 3*c*, and are further conveyed to a transferring position by a pair of conveying rollers 3*d* and a pair of conveying rollers 3*e*.

A transferring roller 4 as transferring means is disposed at the transferring position, and by a voltage (transfer bias)

being applied thereto, a toner image on a photosensitive drum 7 as an image bearing member is transferred to the recording medium.

The photosensitive drum 7 is charged by charging means 8, and then a laser beam is applied thereto from optical means 1, whereby a latent image conforming to image information is formed on the photosensitive drum 7. The latent image is developed into a visible image, i.e., a toner image (unfixed image) by developing means 9.

The recording medium 2 to which the toner image has been transferred is conveyed to fixing means 5 via a conveying belt 3*f*. The fixing means 5 applies heat and pressure to the recording medium 2 passing therethrough to thereby fix the transferred toner image (unfixed image) on the recording medium 2.

Particularly, if the fixing means 5 is of the film heating type, heat-resistant film (heat-resistant fixing film) which is a heating rotary member is brought into close contact with a heat generating member by a pressure rotary member (elastic roller).

The heat-resistant fixing film is nipped by and between the heating member and the pressure member, whereby a pressure contact nip portion is formed, and the recording medium bearing the unfixed image thereon is introduced into between the heat-resistant fixing film and the pressure member and is conveyed with the heat-resistant fixing film, and by the heat from the heating member imparted through the heat-resistant fixing film and the pressure of the pressure contact nip portion, the unfixed image is fixed as a permanent image on the recording medium.

Thereafter, the recording medium is conveyed by a pair of discharging rollers 3*g* and a pair of discharging rollers 3*h* and is discharged onto a discharge tray 6.

Also, a fan 10 as outside air intake means is provided on a side of the main body of the image forming apparatus, and takes the outside air into an air trunk formed in the apparatus to thereby prevent the internal temperature of the apparatus from rising.

Figure 6:
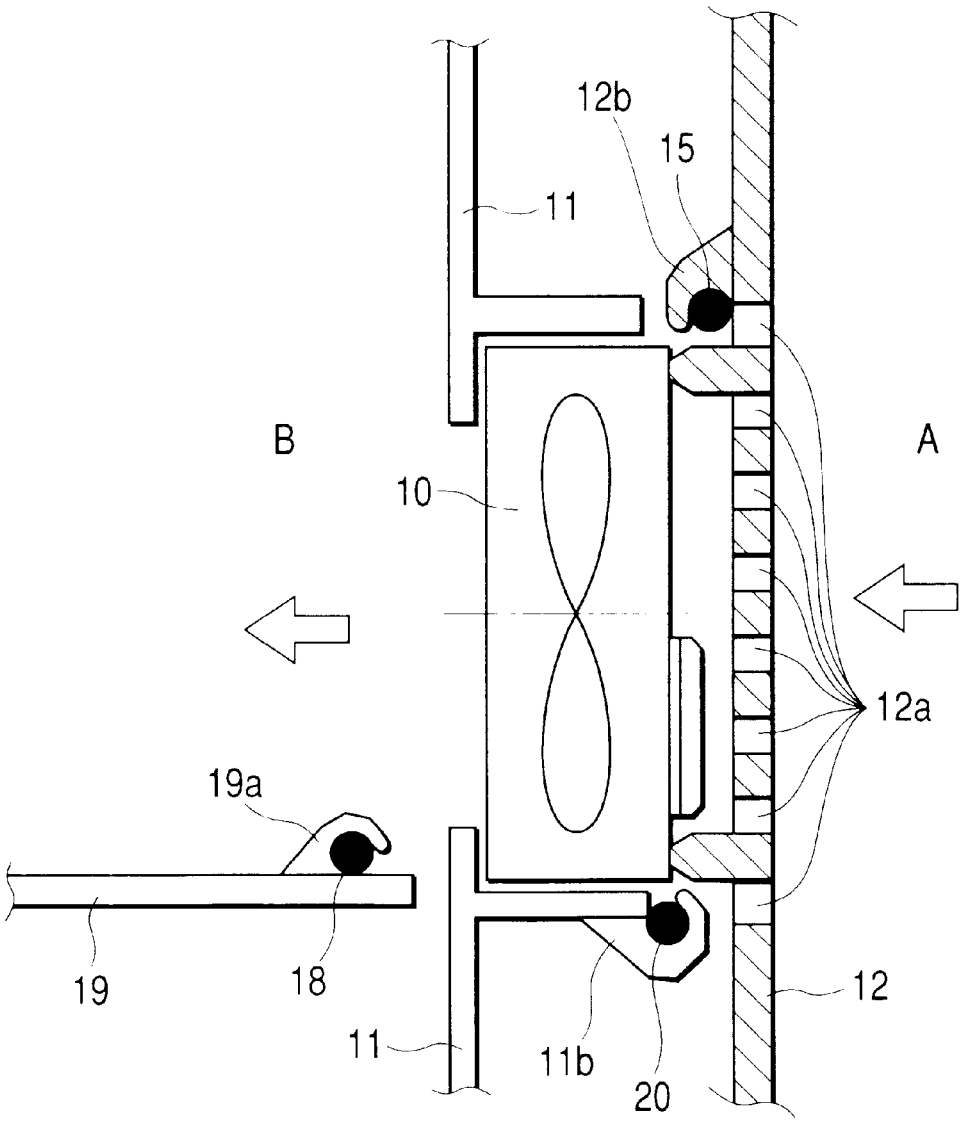
FIG. 6 is a typical cross-sectional view of the essential portions (in the vicinity of the fan) of image forming apparatus according to fourth, sixth and seventh embodiments of the present invention.

As shown in FIG. 6, the fan 10 is installed on a frame 11 in the main body of the apparatus, and during its operation, the fan 10 acts to suck the outside air into the main body. The outside air, as indicated by arrow, is sent from the exterior A of the apparatus into the interior B of the apparatus via louvers 12*a* as outside air intake ports (opening portions) formed in a housing member 12.

Figure 7:
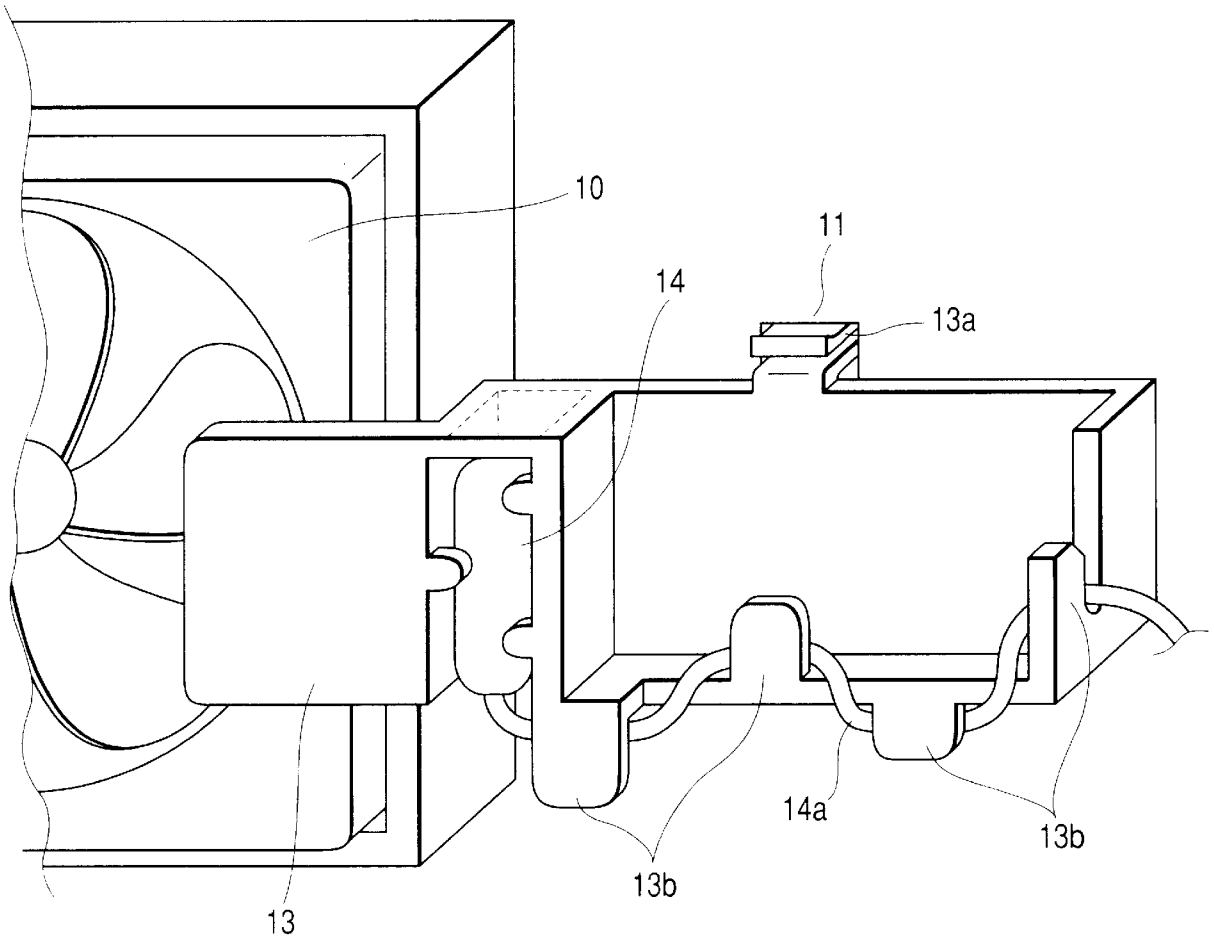
FIG. 7 is a typical perspective view of the essential portions (in the vicinity of the fan) of an image forming apparatus according to a third embodiment of the present invention.

Also, as shown in FIG. 7, the fan 10 has its position regulated by a fan hold-down member 13, which is fixed to the frame 11 by the restraining portion 13*a* thereof.

A thermistor 14 which is an outside air temperature detecting sensor is attached to the fan hold-down member 13, and the conductor 14*a* thereof is led around by the hook ribs 13*b* of the fan hold-down member 13.

By such a construction, in the present embodiment, the thermistor 14 is disposed in the vicinity of the suction type fan 10 and the outside air (outside air intake ports), and by utilizing the forced convection by the fan 10, it becomes possible to detect the outside air temperature with good accuracy (accurately and with good response) and obtain the information thereof.

Figure 11:
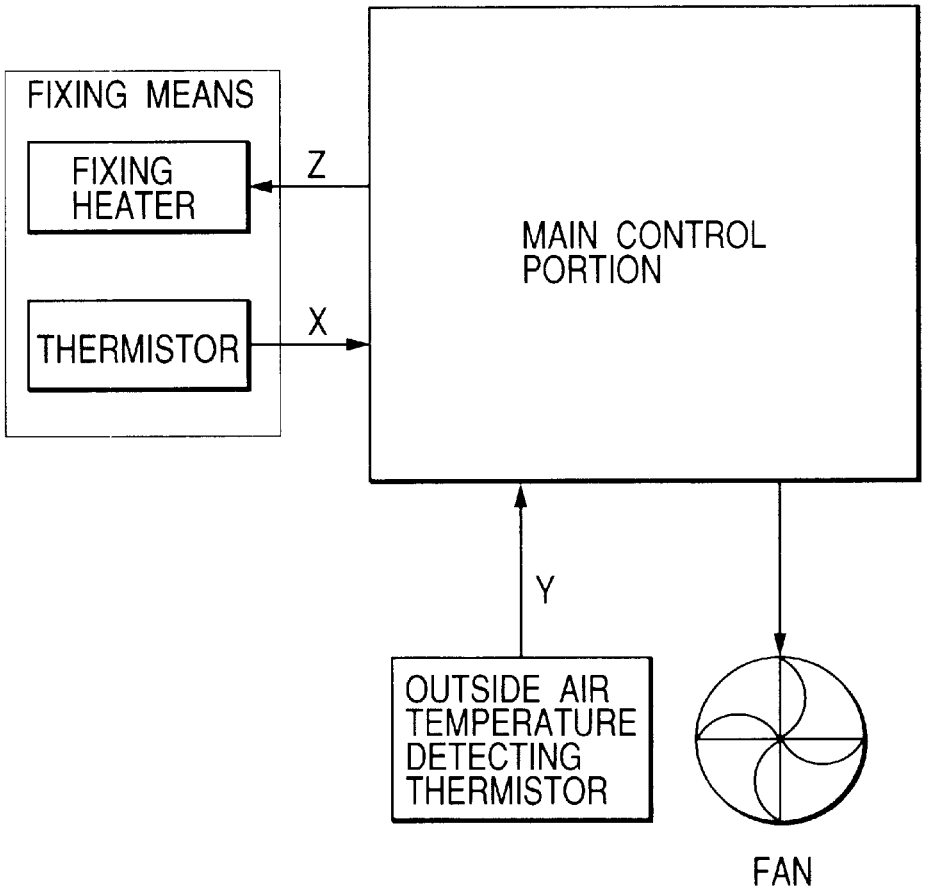
FIG. 11 is a block diagram of the main control portion of the image forming apparatus according to the third embodiment of the present invention.

Here, a main control portion as controlling means for controlling the main body of the printer on the basis of the temperature information (X) of the fixing portion by a fixing portion thermistor provided in the fixing means 5 as shown in the block diagram of FIG. 11 and the outside air temperature information (Y) by the aforementioned thermistor 14 effects appropriate power supply control (Z) to the fixing heater portion, whereby it becomes possible to effect accurate temperature adjustment (the setting of the heating temperature) of the fixing heater portion.

Accordingly, bad images by the influence of the outside air temperature can be prevented.

Also in transfer bias control, it becomes possible to grasp outside air temperature information and in addition, determine an appropriate transfer bias taking the outside air temperature into account. Further, it is also possible to give the action of changing the rotational speed of the fan (adjusting the outside air intake amount) on the basis of the outside air temperature information, and stabilizing the temperature in the apparatus.

It would also occur to mind to dispose the above-described thermistor 14 in the vicinity of the outside air and on an electrical equipment board, but in such case, there is the possibility of the thermistor 14 being affected by the temperature rise of the board itself, and when for example, the responsiveness from after the fan has been started until the temperature of the vicinity of the thermistor 14 becomes constant is taken into account, the detection accuracy of the present embodiment can be said to be more advantageous.

Figure 12:
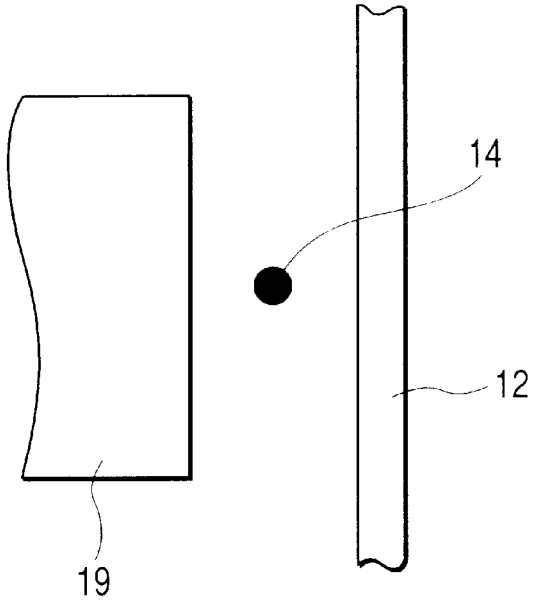
FIG. 12 is a typical view showing the disposition relation between the essential portions of the image forming apparatus according to the third embodiment of the present invention.
Figure 13:
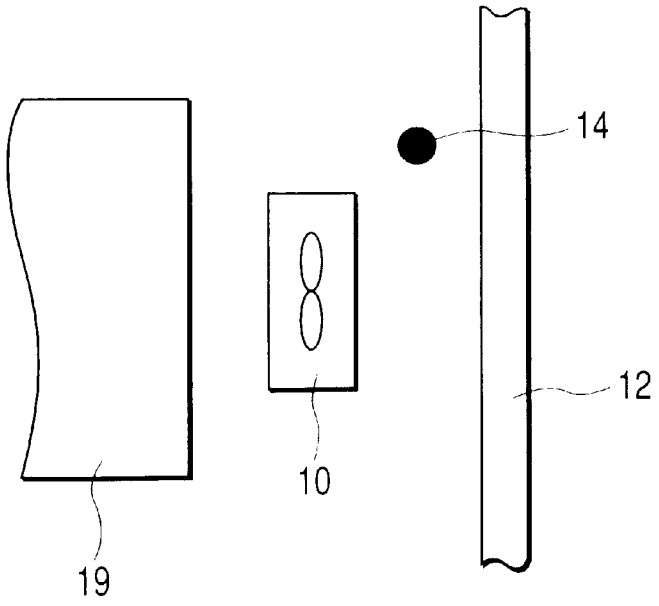
FIG. 13 is a typical view showing the disposition relation between the essential portions of the image forming apparatus according to the third embodiment of the present invention.

Reference is now had to FIGS. 12 and 13 to describe such an arrangement that the thermistor 14 is not affected by the heat of the electrical equipment board 19. FIGS. 12 and 13 are typical views (top plan views) showing the disposition relation between respective portions in which the main body of the apparatus is seen and projected from a vertical direction.

As shown in FIG. 12, the thermistor 14 may preferably be disposed between the electrical equipment board 19 and the housing member 12.

By the thermistor 14 being thus disposed, the outside air is sent into the interior of the apparatus via the louvers 12*a* (not shown in FIG. 12) as the outside air intake ports (opening portions) formed in the housing member 12 and therefore, it becomes possible to reduce the influence of the heat generated from the electrical equipment board 19 upon the thermistor 14.

Also, if as shown in FIG. 13, a fan 10 for creating an air flow from the outside toward the inside is disposed between the electrical equipment board 19 and the thermistor 14, it will be more preferable.

Thereby, it becomes possible to further reduce the influence of the heat generated from the electrical equipment board 19 upon the thermistor 14.

<Embodiment 4>

While in the third embodiment, description has been made of the construction in which the temperature detecting sensor for detecting the temperature of the outside air is attached to the fan hold-down member, in the present embodiment, description will be made of a construction in which the temperature detecting sensor is attached to the housing member.

Figure 10:
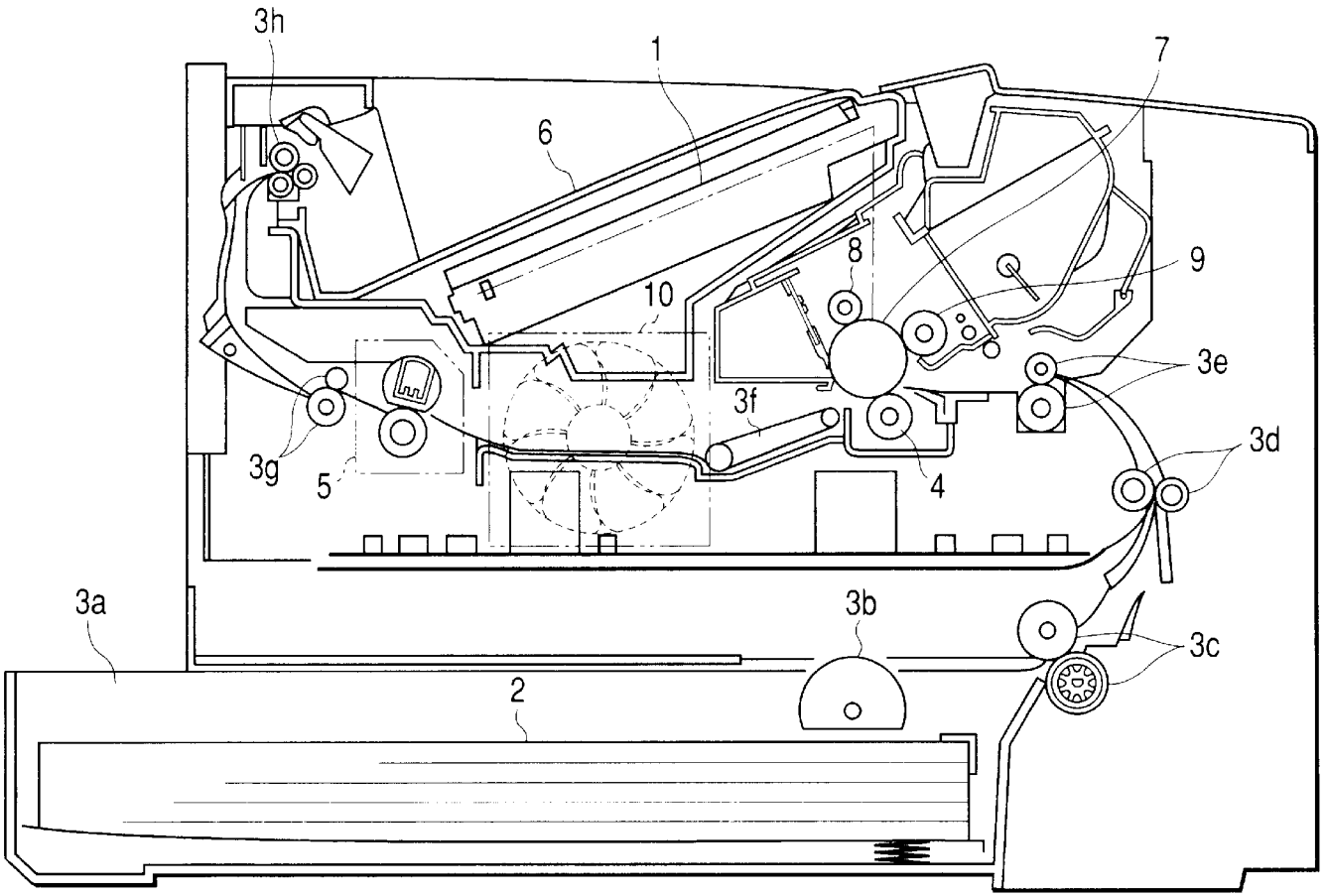
FIG. 10 is a typical cross-sectional view of an image forming apparatus according to the related art.

In the other points, the construction and action of the present embodiment are the same as those of the third embodiment and therefore, the same construction need not be described and for the convenience of description, reference is had to FIGS. 6 and 10 referred to also in the third embodiment.

The difference of the present embodiment from the third embodiment is that a thermistor 15 for detecting the temperature of the outside air is provided on the housing member 12. The housing member 12 is provided with a thermistor holding portion 12*b*, on which the thermistor 15 is held.

Again in the present embodiment, the thermistor 15 is disposed in the vicinity of the suction type fan 10 and the outside air (outside air intake port), and by utilizing the forced convection by the fan 10, it becomes possible to detect the outside air temperature accurately and obtain the information thereof, and an effect similar to that of the third embodiment is obtained.

<Embodiment 5>

An image forming apparatus according to a fifth embodiment of the present invention will now be described with reference to FIG. 8. While in the third embodiment, description has been made of the construction in which the temperature detecting sensor for detecting the temperature of the outside air is attached to the fan hold-down member, in the present embodiment, description will be made of a construction in which the temperature detecting sensor is attached to a filter member for preventing the entry of foreign substances when the outside air is introduced by the fan.

In the other points, the construction and action of the present embodiment are the same as those of the third embodiment and therefore, the same constituent portions are given the same reference characters and suitably need not be described.

Figure 8:
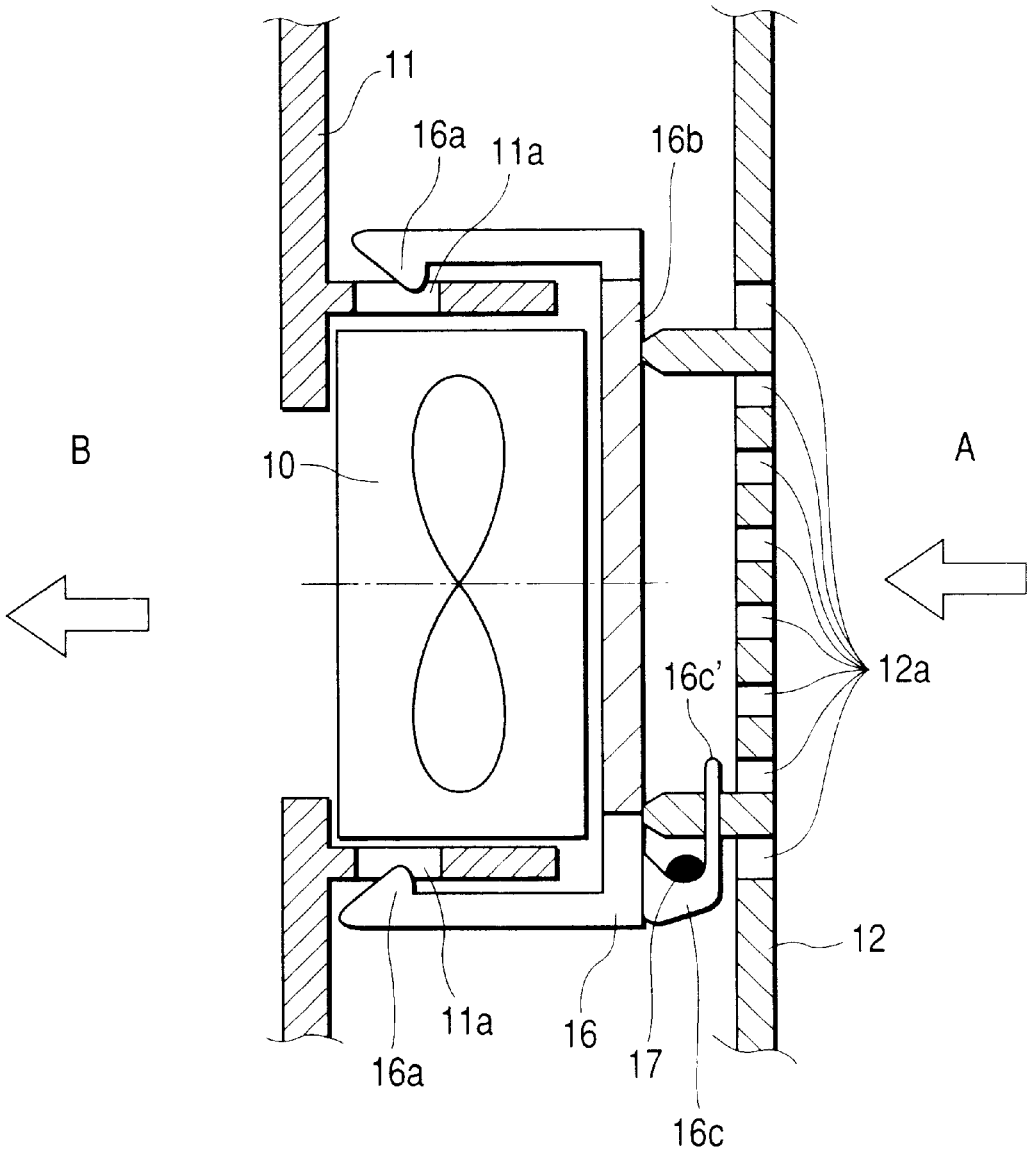
FIG. 8 is a typical cross-sectional view of the essential portions (in the vicinity of the fan) of an image forming apparatus according to a fifth embodiment of the present invention.

FIG. 8 is a typical cross-sectional view showing the essential portions of the image forming apparatus according to the fifth embodiment of the present invention.

In the present embodiment, a dustproof filter member 16 is fixed by filter pawl portions 16*a* being restrained in the aperture portions 11*a* of a frame 11. A mesh-like filter portion 16*b* is disposed between the fan 10 and the housing member 12.

The difference of the present embodiment from the above-described third embodiment is that a thermistor 17 for detecting the temperature of the outside air is held on the thermistor holding portion 16*c* of the filter member 16. Again in the present embodiment, the thermistor 17 is disposed in the vicinity of the suction type fan 10 and the outside air (outside air intake port), and by utilizing the forced convection by the fan 10, it becomes possible to detect the outside air temperature accurately and obtain the information thereof, and an effect similar to that of the third embodiment is obtained.

Not only in the present embodiment, but also in the other embodiments, it is desirable to provide an insulating portion 16*c*' between the louvers 12*a* and the thermistor 17 and earn an edge surface distance to thereby pay consideration to the destruction by static electricity.

<Embodiment 6>

While in the third embodiment, there has been shown the construction in which the temperature detecting sensor for detecting the temperature of the outside air is attached to the fan hold-down member, in the present embodiment, description will be made of a construction in which the temperature detecting sensor is attached onto the electrical equipment board.

In the other points, the construction and action of the present embodiment are the same as those of the third embodiment and therefore, the same constituent portions need not be described, and for the convenience of description, reference is had to FIGS. 6 and 10 referred to also in the third embodiment.

The difference of the present embodiment from the third embodiment is that a thermistor 18 for detecting the temperature of the outside air is held on a thermistor holding portion 19*a* on the electrical equipment board 19.

Again in the present embodiment, the thermistor 18 is disposed in the vicinity of the suction type fan 10 and the outside air (outside air intake port), and by utilizing the forced convection by the fan 10, it becomes possible to detect the outside air temperature accurately and obtain the information thereof, and an effect similar to that of the third embodiment is obtained.

<Embodiment 7>

While in the third embodiment, there has been shown the construction in which the temperature detecting sensor for detecting the temperature of the outside air is attached to the fan hold-down member, in the present embodiment, description will be made of a construction in which the temperature detecting sensor is attached to the main body frame.

In the other points, the construction and action of the present embodiment are the same as those of the third embodiment and therefore, the same constituent portions need not be described, and for the convenience of description, reference is had to FIGS. 6 and 10 referred to also in the above-described third embodiment.

The difference of the present embodiment from the third embodiment is that a thermistor 20 for detecting the outside air temperature is held on the thermistor holding portion 11*b* of the frame 11 of the main body of the apparatus.

Again in the present embodiment, the thermistor 20 is disposed in the vicinity of the suction type fan 10 and the outside air (outside air intake port), and by utilizing the forced convection by the fan 10, it becomes possible to detect the outside air temperature accurately and obtain the information thereof, and an effect similar to that of the third embodiment is obtained.

<Embodiment 8>

An image forming apparatus according an eighth embodiment of the present invention will now be described with reference to FIG. 9. While in each of the above-described embodiments, there has been shown the construction to which the fan for creating an air flow from the external side toward the internal side of the apparatus is applied, in the present embodiment, description will be made of a construction to which a fan for creating an air flow from the internal side toward the external side of the apparatus is applied.

In the other points, the construction and action of the present embodiment are the same as those of the third embodiment and therefore, the same constituent portions are given the same reference characters and suitably need not be described.

Figure 9:
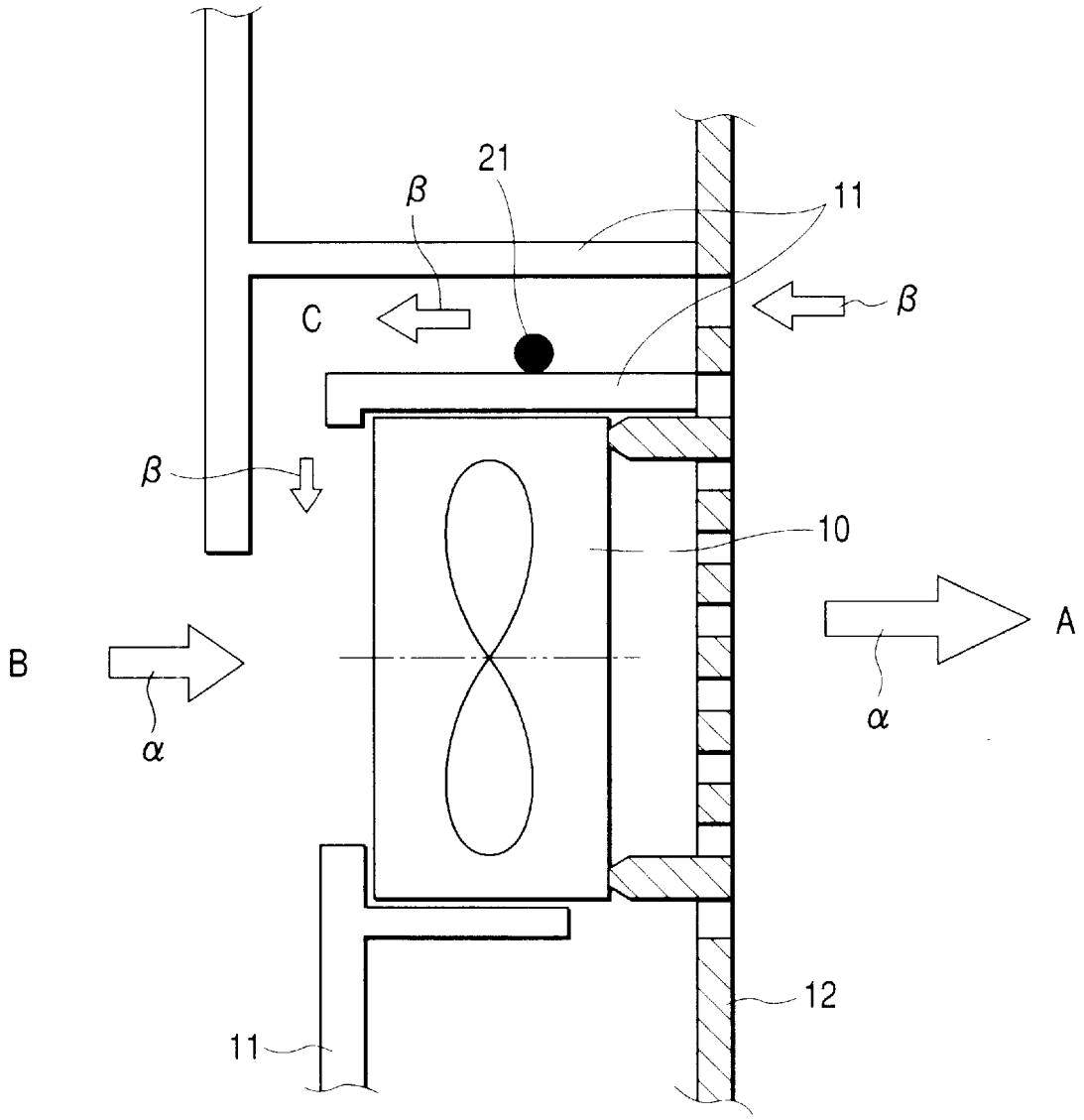
FIG. 9 is a typical cross-sectional view of the essential portions (in the vicinity of the fan) of an image forming apparatus according to a sixth embodiment of the present invention.

FIG. 9 is a typical cross-sectional view showing the essential portions of the image forming apparatus according to the eighth embodiment of the present invention.

While in all of the embodiments hitherto described, description has been made on the basis of the suction type fan, the fan 10 in the present embodiment exhausts the air in the apparatus from the interior B of the apparatus to the outside air A through an exhaust port.

An outside air intake port (opening portion) is provided in the vicinity of the exhaust port for exhausting the air by the fan 10 so as to be adjacent thereto with a partition wall interposed therebetween.

Accordingly, an air trunk C formed by the frame 11 is designed to be induced by a mainstream a for exhausting the air through the exhaust port and introduce the outside air from the outside air intake port to thereby create a flow.

A thermistor 21 for detecting the temperature of the outside air is provided in the air trunk C, whereby again it becomes possible to detect the outside air temperature accurately and obtain the information thereof, and an effect similar to that of the third embodiment is obtained.

While in the foregoing, the adjustment of the heating temperature to the fixing means, the adjustment of the transfer bias and the adjustment of the outside air intake amount by the fan (outside air intake means) have been described as the image forming conditions for effecting the control and setting on the basis of the detected outside air temperature, this is of course not restrictive, but the present invention can be applied to the control of other various conditions directly or indirectly affecting the quality of image.

While the invention has been described with reference to the structure disclosed herein, it is not confined to the details set forth and this application is intended to cover such modifications or changes as may come within the purposes of the improvements or the scope of the following claims.

What is claimed is:

1. An image forming apparatus comprising:

an air intake port that permits an airflow of external ambient air into the interior of the image forming apparatus;

a temperature detecting sensor disposed in a vicinity of the air intake port, in the air flow permitted by the air intake port, that detects the temperature of the external ambient air; and a controller that controls a setting of image forming conditions based on the temperature of the external ambient air detected by said temperature detecting sensor.

2. An image forming apparatus according to claim 1, further comprising a fan provided in a vicinity of the air intake port, and wherein said temperature detecting sensor is installed in a vicinity of said fan.

3. An image forming apparatus according to claim 1, further comprising a fan provided in a vicinity of an exhaust port formed in a housing of the apparatus for creating air flow from the interior of the image forming apparatus to the exterior of the image forming apparatus through said exhaust port, and wherein said air intake port is formed in a vicinity of said exhaust port with a partition wall therebetween.

4. An image forming apparatus according to claim 3, wherein a plurality of air trunks are formed by said fan, and one of said plurality of air trunks is an air trunk directed from said air intake port to said exhaust port while being regulated by said partition wall.

5. An image forming apparatus according to claim 1, wherein the image forming conditions of which the setting is controlled by said controller include a heating temperature of fixing means for heating an unfixed image formed on a sheet to thereby fix the image to the sheet.

6. An image forming apparatus according to claim 1, wherein the image forming conditions of which the setting is controlled by said controller include a transfer bias of transferring means for transferring a developed image formed on an image bearing member onto a sheet.

7. An image forming apparatus according to claim 1, wherein the image forming conditions of which the setting is controlled by said controller include an outside air intake amount of said air intake port for adjusting a temperature of an interior of the apparatus.

8. An image forming apparatus comprising:

a temperature detecting sensor for detecting an ambient temperature;

control means for controlling a setting of image forming conditions based on said temperature detecting sensor;

an electrical equipment board; and an apparatus housing having an opening portion as an outside air intake port, wherein in a projection plane of a main body of the apparatus as viewed along a vertical direction, said temperature detecting sensor is disposed between said electrical equipment board and said apparatus housing.

9. An image forming apparatus according to claim 8, wherein in the projection plane of the main body of the apparatus as viewed along the vertical direction, a fan for creating an air flow from an external side to an internal side of the apparatus is disposed between said electrical equipment board and said temperature detecting sensor.

10. An image forming apparatus according to claim 8, wherein temperatures detected by said temperature detecting sensor during a non-recording operation are averaged for a predetermined time period to find an average value, and a value obtained by subtracting a predetermined value from the average value is judged as the ambient temperature.

11. An image forming apparatus for effecting image recording on a recording sheet by an electrophotographic process, said image forming apparatus comprising:

a cooling fan;

a temperature sensor disposed in a vicinity of said cooling fan; and outside air temperature calculating means for calculating an outside air temperature based on temperature information from said temperature sensor, wherein a parameter of the electrophotographgic process is changed based on outside air temperature information from said outside air temperature calculating means, and wherein said outside air temperature calculating means finds an average value obtained by averaging temperatures detected by said temperature sensor during a non-recording operation for a predetermined time period, and judges a value obtained by subtracting a predetermined value from the average value as the outside air temperature.

12. An image forming apparatus according to claim 11, wherein when a power source switch is closed, said outside air temperature calculating means, judges a temperature detected by said temperature sensor immediately after a closing of the power source switch as the outside air temperature, and retains the temperature as the outside air temperature for a predetermined time period.

13. An image forming apparatus according to claim 11, wherein during the non-recording operation, said cooling fan is intermittently driven at a predetermined cycle period, and said outside air temperature calculating means judges a value obtained by subtracting a predetermined value from an average temperature at each predetermined cycle period as the outside air temperature.

* * * * *

UNITED STATES PATENT AND TRADEMARK OFFICE

CERTIFICATE OF CORRECTION

PATENT NO. : 6,594,456 B2 
DATED : July 15, 2003
INVENTOR(S) : Eiichiro Kimizuka et al.

It is certified that error appears in the above-identified patent and that said Letters Patent is hereby corrected as shown below:

Column 1,
Line 64, “into between” should read -- between --.

Column 9,
Line 25, “into between” should read -- between --.

Column 10,
Line 22, “had” should read -- made --.

Column 11,
Line 58, “had” should read -- made --.

Column 12,
Line 56, “mainstream a” should read -- mainstream α --.
Line 58, “flow.” should read -- flow β --.

Column 14,
Line 46, “means,” should read -- means --.

Signed and Sealed this

Twentieth Day of January, 2004

JON W. DUDAS
*Acting Director of the United States Patent and Trademark Office*